United States Patent [19]

Hutchinson

[11] 4,167,320

[45] Sep. 11, 1979

[54] VERTICAL FILM PROCESSING APPARATUS

[75] Inventor: William J. Hutchinson, Rochester, N.Y.

[73] Assignee: Eastman Kodak Company, Rochester, N.Y.

[21] Appl. No.: 906,169

[22] Filed: May 3, 1978

Related U.S. Application Data

[63] Continuation of Ser. No. 774,720, Mar. 7, 1977, abandoned.

[51] Int. Cl.[2] ..... G03D 3/04

[52] U.S. Cl. ..... 354/323; 354/330; 354/338; 354/340; 134/149; 134/159

[58] Field of Search ..... 134/140, 149, 157, 159, 134/160; 354/297, 311, 312, 313, 314, 315, 316, 319, 320, 321, 322, 323, 324, 328, 329, 330, 331, 335, 337, 338, 339, 340, 344

[56] References Cited

U.S. PATENT DOCUMENTS

| | | | |
|---|---|---|---|
| 1,185,191 | 5/1916 | Garland | 354/316 |
| 1,373,311 | 3/1921 | Gorsky | 134/157 |
| 2,663,305 | 12/1953 | Anderes et al. | 134/140 |
| 2,947,236 | 8/1960 | Siegel | 354/330 |
| 3,349,686 | 10/1967 | Buechner | 354/341 |
| 3,623,416 | 11/1971 | Anderberg | 354/313 |
| 3,682,080 | 8/1972 | Merz | 354/330 |
| 3,760,822 | 9/1973 | Evans | 134/140 |
| 3,938,171 | 2/1976 | Masygan | 354/314 |
| 4,001,852 | 1/1977 | Gall | 354/313 |
| 4,011,573 | 3/1977 | Braico | 354/329 |

FOREIGN PATENT DOCUMENTS

| | | | |
|---|---|---|---|
| 2216778 | 8/1974 | France | 354/330 |

*Primary Examiner*—L. T. Hix
*Assistant Examiner*—Alan Mathews
*Attorney, Agent, or Firm*—J. A. Matthews

[57] ABSTRACT

A processing apparatus has a processing chamber configured to receive a plurality of cylindrically-shaped film units. The film units comprise a plurality of film discs supported by a central aperture on an elongated shaft, in spaced relation and with the disc faces normal to the shaft axis, and end drive discs slightly larger in diameter than the film discs. The drive discs have a guide lug extending from their exposed sides and guide grooves are provided in the processing chamber interior. The first inserted film unit is directed into driving engagement with a drive means located at the lower portion of the chamber and subsequently inserted film units are directed into driving relation with the unit therebeneath. Processing fluids are sequentially introduced and discharged from the chamber with the film units rotating to effect film development.

8 Claims, 4 Drawing Figures

VERTICAL FILM PROCESSING APPARATUS

This is a continuation of application Ser. No. 774,720 filed Mar. 7, 1977, now abandoned.

BACKGROUND OF THE INVENTION

1. Field of the Invention

The present invention relates to apparatus for processing photographic film and in particular to such apparatus in which a plurality of film units, each including a plurality of discrete, disc-shaped film elements, are stacked in a drive transmitting relation in a processing chamber into which appropriate chemical processing fluids are introduced.

2. Description of the Prior Art

A multitude of devices have been heretofore devised for processing photographic film. Common concerns for processing film in any such devices are the desire to minimize mechanical contact with front and back surfaces of the film and the desire to obtain an intimate contact between the film surfaces to be processed and the processing solutions, in proper concentration and without external contaminates or carryover between different processing solutions. A further desire from the economic viewpoint is to provide apparatus which is low in cost and simple in operation, yet capable of high quantity through-put with uniformly high quality results.

Processing apparatus design to a large extent is constrained by the configuration or format of the film elements to be handled, and, to date, most such apparatus have been adapted particularly for strip film. Two common general types of processors for strip film are (1) continuous processors in which the strip is fed by drive and guide rollers through the various processing stations and (2) reel processors in which film strips are wound spirally about a reel that are then manipulated into and out of the processing stations. Shorter strips are often spliced to form a longer strip.

Devices for processing film elements of other formats, e.g., chips, or small sheets have not been so common. One popular approach is to support a plurality of film chips to be processed in a rack and sequentially dip the rack into treating reservoirs.

SUMMARY OF THE INVENTION

It is a purpose of the present invention to provide for processing of discrete film elements of a novel format in a manner which achieves the desirable characteristics mentioned above and offers significant advantages in various aspects over prior art devices.

Thus one object of the present invention is to provide improved apparatus and approach for processing photographic film.

Another object of the present invention is to provide improved apparatus for processing small, discrete film elements.

A more specific object is to provide such apparatus which minimizes mechanical contact with important image areas of the film.

Another more specific object is to provide such apparatus which enhances processing fluid contact with important image areas of the film.

Another more specific object is to provide such apparatus which is simplified in design.

The above and other objects and advantages are achieved in accordance with the present invention by processing apparatus which supports a plurality of disc-like film elements to be developed in spaced relation on a shaft passing generally through the center and normal to the face of the film disc. The image portions of the film elements are located in an annular zone spaced slightly from supporting aperture at the center of the element. After a plurality of the disc elements are arranged on the shaft, a slightly larger drive disc is attached to the shaft ends and a cylindrical film unit of film elements to be developed is thus provided.

The processor comprises a processing chamber having guide means for directing an inserted film unit into driving relation with a processing drive located at the bottom of the chamber. In a multiunit processor embodiment guide means can be provided for directing subsequently inserted units into driving relation with the first inserted film unit. Processing fluids are introduced and discharged from the chamber as drive is transmitted to the stacked array of film units.

BRIEF DESCRIPTION OF THE DRAWINGS

The invention is hereinafter described in connection with the attached drawings which form a part hereof and in which.

DETAILED DESCRIPTION OF THE PREFERRED EMBODIMENTS

Figure 1:
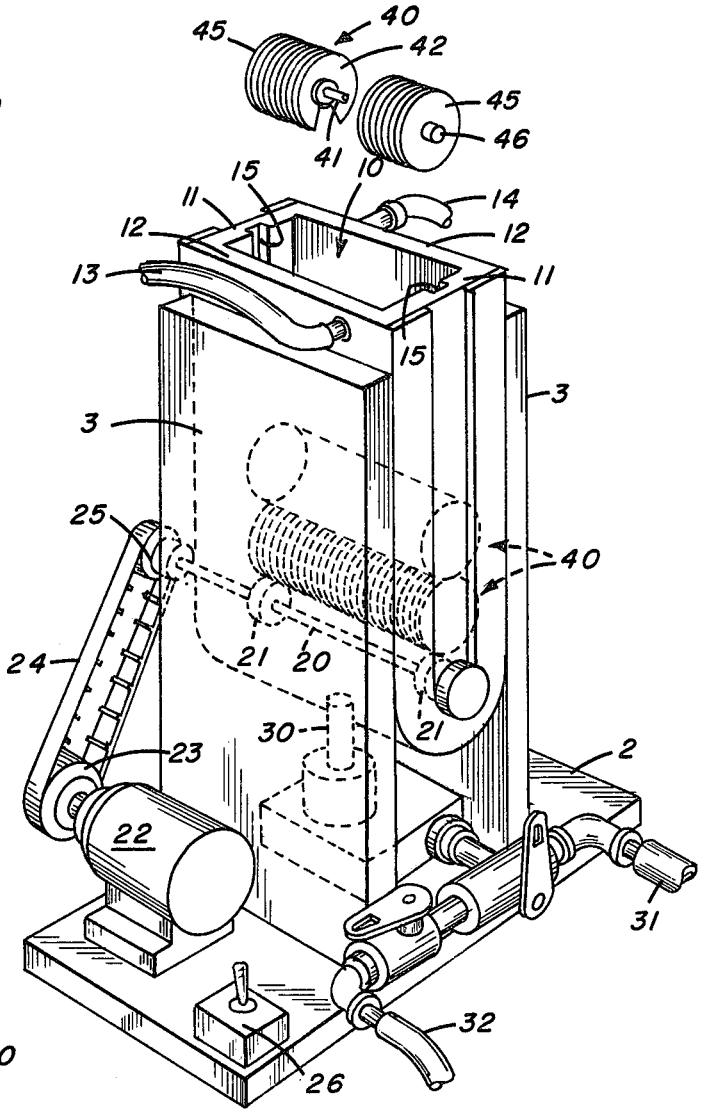
FIG. 1 is a perspective view of a processing apparatus embodying the present invention.

The processing apparatus 1 shown in FIG. 1 comprises a frame portion that includes a support plate 2 with two upstanding support walls 3 extending therefrom. Supported between the walls 3 and spaced from plate 2 is means defining a processing chamber 10 comprising end walls 11 and side walls 12 which join at the bottom to form a generally closed bottom to the chamber. The top of the chamber has loading opening for receiving film units 40, which will be described subsequently in more detail. The walls of the chamber are themselves desirably hollow to form a temperature control jacket into which a temperature control fluid can be introduced through conduit 13 and discharged through conduit 14. Grooves 15 are provided on the interior surface of end walls 11 and desirably extend from the top to the lower portion of the chamber.

Extending between and through end walls 11 at the lower portion of the chamber is a drive shaft 20, which is journalled in the walls by fluid tight bearings and which includes spaced drive rollers 21. The peripheral surfaces of the rollers 21 are serrated, or otherwise roughened to provide good frictional property, and are located along the shaft 20 at a predetermined position to engage drive surfaces of an inserted film unit. Mounted on support plate 2 is a motor 22 whose output shaft drives pulley 23. Drive belt 24 drivingly couples pulley 23 to a pulley 25 keyed to a portion of shaft 20 which extends beyond the exterior of end wall 11. Switch 26 couples motor 22 to a conventional power source, not shown.

In the space between the bottom of the chamber defining means and plate 2, a first conduit 30 is coupled to an opening, which extends in the bottom wall through the jacket into the processing chamber 10. Conduits 31 and 32 respectively couple conduit 30 to sources of fresh processing fluids and a discharge sump. It will be appreciated that supply conduit 31 can be used to supply different fluids, such as developer, fix, water and air into the chamber by appropriate valving means well known in the art and not shown.

Figure 3:
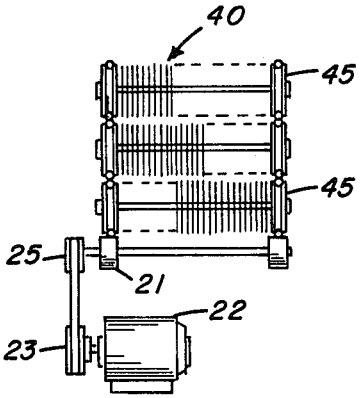
FIG. 3 is a schematic view illustrating details of film unit drive within the apparatus of FIG. 1.
Figure 4:
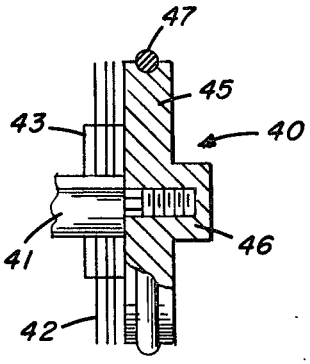
FIG. 4 is an enlarged fragmentary view, with portions broken away, of an end of a film unit embodiment of the present invention.

The film units 40, as shown in FIGS. 1, 3 and 4 comprise an elongated drive and support shaft 41 on which are placed a plurality of film discs 42 to be processed. The discs 42 are desirably spaced by a central portion 43 to prevent inter-film contact and allow access to processing fluid. The film discs are desirably keyed to, or frictionally retained on, the shaft 41 to facilitate rotation therewith. After a plurality of film discs are loaded onto the shaft 41, end portions 45 are screwed or otherwise fixed onto the shaft ends. As shown in more detail in FIG. 4, the end portions are disc-shaped and of diameter slightly larger than that of the film discs 42. "O-rings" 47 are provided in a groove around the periphery of disc 45 and a central locating lug 46 protrudes from the external surface.

Figure 2:
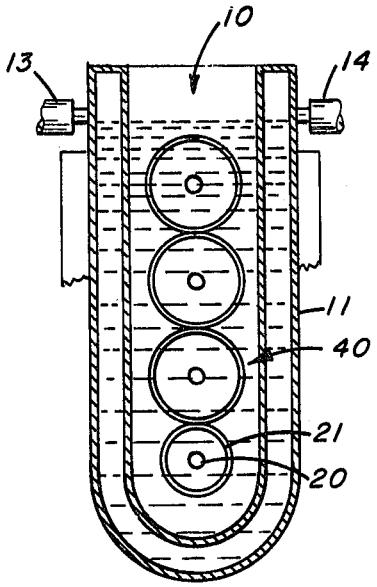
FIG. 2 is a cross-sectional view of a portion of the embodiment shown in FIG. 1.

Referring now to FIGS. 1 and 2 it can be seen that lugs 46 are configured to fit slidingly in grooves 15 of the processing chamber to direct inserted film units, the first such unit inserted being guided to the bottom of the chamber so that its "O-rings" are in driving contact with drive rollers 21. As shown in FIG. 2 successive film units are inserted until the chamber space is substantially full, each successive film unit moving into a position where its O-rings are held in driving engagement with the previously inserted unit by gravity. As shown in FIG. 3, drive from motor is thus transmitted to rotate each of the film units in the chamber, the film units themselves forming a portion of the drive transmission train.

With all film units 40 of a batch to be processed in the processor as described, drive is commenced by energization of motor 22; and the first processing fluid, e.g., developer, is introduced through conduits 31 and 30 to the level such as shown in FIG. 2. It is often desirable for temperature critical processes to precondition the jacket by circulation of a fluid, e.g., temperature controlled water through conduits 13 and 14.

After completion of treatment with the first processing liquid, it is drained through conduits 30 and 32 and the next solution introduced, and so on, until liquid treatment is complete in accordance with the chemistry of the film and process. Drying can then be advantageously effected by rotation of the film units in the chamber, e.g., at a higher speed and with warm air being introduced through conduit 30. It also has been found advantageous in some processes to provide a spin removal of residual solution prior to introduction of the next solution, which also can be effected by control of motor 22.

Although the invention has been disclosed herein in a multi-film-unit embodiment, it will be appreciated that certain advantages of the invention pertain to a single film unit embodiment.

Also, it will be appreciated that other configurations of stacking can be utilized to effect the self-transmitting drive of a plurality of such film units.

The invention has been described in detail with particular reference to certain preferred embodiments thereof, but it will be understood that variations and modifications can be effected within the spirit and scope of the invention.

What is claimed is:

1. Apparatus for photographically processing, in a solution, sets of disc-shaped film elements; each set including (1) a shaft which extends through an aperture in a central section of each element, and (2) generally circular end members of a diameter at least slightly larger than the diameter of the film elements; said apparatus comprising:

a container having a processing chamber for receiving the solution, said chamber being adapted to receive a plurality of the sets in the solution with the shafts extending parallel to each other;

means for rotatably supporting the sets in the solution with the end members of adjacent shafts in drive-transmitting engagement; and drive means for rotating one of the sets in the solution, rotation of the one set by said drive means causing rotation of the other sets through the engaged end members to thereby enhance the contact between the film elements and the solution.

2. The invention defined in claim 1, further including means for introducing and removing a plurality of processing fluids into and from said chamber.

3. Apparatus for suspending in a processing solution sets of disc-shaped film elements; each set including (1) a shaft extending through an aperture in a central section of each element of the set to support the elements for rotation with the shaft, and (2) axially-spaced generally-circular members supported on the shaft for rotation with the shaft and having a diameter at least slightly larger than the diameter of the film elements; said apparatus comprising:

a container having a processing chamber for receiving the processing solution and for receiving a plurality of the sets immersed in the solution;

guide means for positioning the sets in the chamber one above another in the solution, and with the circular members of adjacent sets in drive-transmission engagement, such that rotation of the one shaft will rotate the other shafts; and drive means extending into said processing chamber for rotating one of the sets in the chamber.

4. Apparatus for processing in a photographic processing solution film elements supported on a shaft; the film elements each having a generally disc-shaped configuration, a central aperture and a planar image surface spaced radially from such aperture; the shaft having a longitudinal axis and configured to support a plurality of the film elements with their image surfaces in spaced relation substantially normal to the axis, the shaft further supporting a pair of disc-shaped end members coupled to the shaft for rotation with the shaft; said apparatus comprising:

means having a vertically elongate chamber for the processing solution, the chamber being adapted to receive a plurality of shafts and their supported film elements in vertically stacked relationship;

drive means having an output drive member located in the lower portion of said processing chamber; and means in said processing chamber for directing at least one of the end members of a first inserted shaft into driving engagement with said output drive member, and for directing the end members of subsequently inserted shafts into driving engagement with the end members of previously inserted shafts.

5. The invention defined in claim 4 further including: means for introducing and discharging a plurality of processing fluids into and from said chamber.

6. Apparatus for processing disc-shaped film elements mounted on film element holders, the film element holders each including a shaft extending through central sections of a plurality of the elements for retaining such elements substantially normal to the longitudinal axis of the shaft, each holder further including a pair of disc-shaped end members of a diameter at least slightly larger than that of the film elements, said apparatus comprising:

(a) means having a vertically elongate processing chamber for receiving the film holders one above another in said processing chamber;

(b) drive means in the lower portion of said processing chamber;

(c) guide means in said processing chamber for directing the end members of a first inserted film holder into driving engagement with said drive means and for directing the end members of each subsequently inserted film holder into driving engagement with the end members of a previously inserted film holder; and (d) means for selectively introducing a plurality of processing fluids into said chamber.

7. Apparatus for processing film elements of the type having a generally disc-shaped configuration, a central aperture and an annular image surface spaced radially from such aperture, said apparatus comprising:

(a) film element unitizing means including (1) an elongate shaft for supporting a plurality of the film elements with their image surfaces in spaced relation and extending substantially normal to the longitudinal axis of the shaft, and (2) a pair of disc-shaped end members having opposed faces extending parallel to the imaging surfaces and having a diameter at least slightly larger than the diameter of the film elements, the end members being affixed to opposite end portions of said shaft respectively, each of said end members having a guide portion extending centrally from a face surface thereof opposite said film elements and at least one of the end members having a peripheral drive surface;

(b) means defining a vertical processing chamber for receiving a plurality of said film element unitizing means one above another;

(c) drive means having an output drive member located in said processing chamber; and (d) guide means for directing the drive surface of a first inserted unitizing means into driving engagement with said output drive member and for directing the drive surface of subsequently inserted unitizing means into driving engagement with the drive surface of a previously inserted unitizing means.

8. The invention defined in claim 7 further including: means for introducing and discharging a plurality of processing fluids into and from said chamber.

* * * * *